US009285699B2

(12) United States Patent
Kelly et al.

(10) Patent No.: US 9,285,699 B2
(45) Date of Patent: Mar. 15, 2016

(54) CARRIER AND DEVELOPER

(71) Applicant: XEROX CORPORATION, Norwalk, CT (US)

(72) Inventors: Bernard A. Kelly, Ontario, NY (US); Thomas C. Dombroski, Rochester, NY (US); Brian S. Giannetto, Livonia, NY (US); Brian E. Moore, Ontario, NY (US); Lloyd D. Spencer, Wolcott, NY (US); Richard P. N. Veregin, Mississauga (CA); Karen A. Moffat, Brantford (CA); Thomas E. Enright, Tottenham (CA); Valerie M. Farrugia, Oakville (CA); Michael S. Hawkins, Cambridge (CA); Wafa F. Bashir, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 78 days.

(21) Appl. No.: 14/267,825

(22) Filed: May 1, 2014

(65) Prior Publication Data

US 2015/0316866 A1 Nov. 5, 2015

(51) Int. Cl.
*G03G 9/113* (2006.01)
*G03G 9/087* (2006.01)

(52) U.S. Cl.
CPC ..... *G03G 9/1133* (2013.01); *G03G 9/08755* (2013.01); *G03G 9/1131* (2013.01); *G03G 9/1135* (2013.01); *G03G 9/1137* (2013.01); *G03G 9/1139* (2013.01)

(58) Field of Classification Search
CPC . G03G 9/1135; G03G 9/1137; G03G 9/1139; G03G 9/1133; G03G 9/1131
USPC ..... 430/111.33, 111.32, 109.4
See application file for complete search history.

(56) References Cited

U.S. PATENT DOCUMENTS

| | | | | |
|---|---|---|---|---|
| 3,873,355 | A * | 3/1975 | Queener | G03G 9/1134 430/111.1 |
| 3,947,271 | A * | 3/1976 | Munzel | G03G 9/1131 430/111.35 |
| 4,070,186 | A * | 1/1978 | Gibson | G03G 9/10 430/109.3 |
| 4,233,387 | A | 11/1980 | Mammino et al. | |
| 4,935,326 | A | 6/1990 | Creatura et al. | |
| 4,937,166 | A | 6/1990 | Creatura et al. | |
| 5,002,846 | A | 3/1991 | Creatura et al. | |
| 5,015,550 | A | 5/1991 | Creatura et al. | |

(Continued)

FOREIGN PATENT DOCUMENTS

| | | | |
|---|---|---|---|
| JP | 2008122444 A | * | 5/2008 |
| JP | 2010049140 A | * | 3/2010 |

OTHER PUBLICATIONS

English language machine translation of JP 2010-049140 (Mar. 2010).*

(Continued)

*Primary Examiner* — Christopher Rodee
(74) *Attorney, Agent, or Firm* — Pillsbury Winthrop Shaw Pittman LLP

(57) ABSTRACT

Disclosed is a carrier suitable for use with an electrophotographic developer and an electrophotographic developer containing the carrier. In particular, the carrier is powder coated and comprises a copolymer of cyclohexylmethacrylate and dimethylaminoethylmethacrylate.

18 Claims, 14 Drawing Sheets

(56) References Cited

U.S. PATENT DOCUMENTS

| | | | | |
|---|---|---|---|---|
| 5,213,936 | A | | 5/1993 | Creatura et al. |
| 5,278,020 | A | | 1/1994 | Grushkin et al. |
| 5,290,654 | A | | 3/1994 | Sacripante et al. |
| 5,302,486 | A | | 4/1994 | Patel et al. |
| 5,308,734 | A | | 5/1994 | Sacripante et al. |
| 5,344,738 | A | | 9/1994 | Kmiecik-Lawrynowicz et al. |
| 5,346,797 | A | | 9/1994 | Kmiecik-Lawrynowicz et al. |
| 5,348,832 | A | | 9/1994 | Sacripante et al. |
| 5,354,638 | A | * | 10/1994 | Harada ..... G03G 9/1133 430/111.32 |
| 5,364,729 | A | | 11/1994 | Kmiecik-Lawrynowicz et al. |
| 5,366,841 | A | | 11/1994 | Patel et al. |
| 5,370,963 | A | | 12/1994 | Patel et al. |
| 5,403,693 | A | | 4/1995 | Patel et al. |
| 5,405,728 | A | | 4/1995 | Hopper et al. |
| 5,418,108 | A | | 5/1995 | Kmiecik-Lawrynowicz et al. |
| 5,484,675 | A | * | 1/1996 | Tripp ..... C09C 1/56 430/108.7 |
| 5,496,676 | A | | 3/1996 | Croucher et al. |
| 5,501,935 | A | | 3/1996 | Patel et al. |
| 5,527,658 | A | | 6/1996 | Hopper et al. |
| 5,585,215 | A | | 12/1996 | Ong et al. |
| 5,650,255 | A | | 7/1997 | Ng et al. |
| 5,650,256 | A | | 7/1997 | Veregin et al. |
| 5,723,253 | A | | 3/1998 | Higashino et al. |
| 5,744,520 | A | | 4/1998 | Kmiecik-Lawrynowicz et al. |
| 5,747,215 | A | | 5/1998 | Ong et al. |
| 5,763,133 | A | | 6/1998 | Ong et al. |
| 5,766,818 | A | | 6/1998 | Smith et al. |
| 5,804,349 | A | | 9/1998 | Ong et al. |
| 5,827,633 | A | | 10/1998 | Ong et al. |
| 5,840,462 | A | | 11/1998 | Foucher et al. |
| 5,853,943 | A | | 12/1998 | Cheng et al. |
| 5,853,944 | A | | 12/1998 | Foucher et al. |
| 5,863,698 | A | | 1/1999 | Patel et al. |
| 5,869,215 | A | | 2/1999 | Ong et al. |
| 5,902,710 | A | | 5/1999 | Ong et al. |
| 5,910,387 | A | | 6/1999 | Mychajlowskij et al. |
| 5,916,725 | A | | 6/1999 | Patel et al. |
| 5,919,595 | A | | 7/1999 | Mychajlowskij et al. |
| 5,925,488 | A | | 7/1999 | Patel et al. |
| 5,977,210 | A | | 11/1999 | Patel et al. |
| 5,994,020 | A | | 11/1999 | Patel et al. |
| 6,042,981 | A | | 3/2000 | Barbetta et al. |
| 6,063,827 | A | | 5/2000 | Sacripante et al. |
| 6,576,389 | B2 | | 6/2003 | Vanbesien et al. |
| 6,617,092 | B1 | | 9/2003 | Patel et al. |
| 6,627,373 | B1 | | 9/2003 | Patel et al. |
| 6,638,677 | B2 | | 10/2003 | Patel et al. |
| 6,656,657 | B2 | | 12/2003 | Patel et al. |
| 6,656,658 | B2 | | 12/2003 | Patel et al. |
| 6,664,017 | B1 | | 12/2003 | Patel et al. |
| 6,673,505 | B2 | | 1/2004 | Jiang et al. |
| 6,730,450 | B1 | | 5/2004 | Moffat et al. |
| 6,743,559 | B2 | | 6/2004 | Combes et al. |
| 6,756,176 | B2 | | 6/2004 | Stegamat et al. |
| 6,780,500 | B2 | | 8/2004 | Dumouchel |
| 6,780,557 | B2 | | 8/2004 | Kawaji et al. |
| 6,830,860 | B2 | | 12/2004 | Sacripante et al. |
| 7,029,817 | B2 | | 4/2006 | Robinson et al. |
| 7,329,476 | B2 | | 2/2008 | Sacripante et al. |
| 7,528,218 | B2 | | 5/2009 | Shirai et al. |
| 7,547,499 | B2 | | 6/2009 | Veregin et al. |
| 8,354,214 | B2 | | 1/2013 | Vanbesien et al. |
| 2005/0064315 | A1 | * | 3/2005 | Yamaguchi et al. ..... 430/111.31 |
| 2006/0222991 | A1 | | 10/2006 | Sacripante et al. |
| 2008/0056769 | A1 | | 3/2008 | Iizuka et al. |
| 2008/0107989 | A1 | | 5/2008 | Sacripante et al. |
| 2011/0070538 | A1 | * | 3/2011 | Vanbesien et al. ..... 430/108.4 |
| 2011/0086301 | A1 | | 4/2011 | Cheng et al. |
| 2011/0097664 | A1 | | 4/2011 | Nosella et al. |

OTHER PUBLICATIONS

English language machine translation of JP 2008-122444 (May 2008).*

Anderson, J.H. "The effect of additives on the tribocharging of electrophotographic toners", Journal of Electrostatics 37 (1996) pp. 197-209.*

Duke, Charles et al. "The surface science of xerography", Surface Science 500 (2002) pp. 1005-1023.*

* cited by examiner

CARRIER AND DEVELOPER

BACKGROUND

Disclosed herein is a carrier suitable for use with an electrophotographic developer and an electrophotographic developer containing the carrier.

Carrier particles for use in electrophotographic developers comprise a roughly spherical core, which can be made from a variety of materials and is coated with a polymeric resin. This resin is often placed on the core by a solution coating process. It has been found, however, that carriers prepared by powder coating processes can have numerous advantages over those prepared by solution coated carriers, such as lower expense of manufacture and improved environmental friendliness in that no solvents are used in the manufacturing process.

Powder coating of carriers can be carried out as disclosed in, for example, U.S. Pat. Nos. 4,233,387, 4,935,326, 4,937,166, 5,002,846, 5,015,550, and 5,213,936, the disclosures of each of which are totally incorporated herein by reference. The polymeric resin can be prepared by emulsion polymerization, as disclosed in, for example, U.S. Pat. No. 6,042,981, the disclosure of which is totally incorporated herein by reference, prior to preparation of the powder.

Numerous processes are within the purview of those skilled in the art for the preparation of toners. Emulsion aggregation (EA) is one such method. Emulsion aggregation toners can be used in forming print and/or xerographic images. Emulsion aggregation techniques can entail the formation of an emulsion latex of the resin particles by heating the resin, using emulsion polymerization, as disclosed in, for example, U.S. Pat. No. 5,853,943, the disclosure of which is totally incorporated herein by reference. Other examples of emulsion/aggregation/coalescing processes for the preparation of toners are illustrated in, for example, U.S. Pat. Nos. 5,278,020, 5,290,654, 5,302,486, 5,308,734, 5,344,738, 5,346,797, 5,348,832, 5,364,729, 5,366,841, 5,370,963, 5,403,693, 5,405,728, 5,418,108, 5,496,676, 5,501,935, 5,527,658, 5,585,215, 5,650,255, 5,650,256, 5,723,253, 5,744,520, 5,747,215, 5,763,133, 5,766,818, 5,804,349, 5,827,633, 5,840,462, 5,853,944, 5,863,698, 5,869,215, 5,902,710; 5,910,387; 5,916,725; 5,919,595; 5,925,488, 5,977,210, 5,994,020, 6,576,389, 6,617,092, 6,627,373, 6,638,677, 6,656,657, 6,656,658, 6,664,017, 6,673,505, 6,730,450, 6,743,559, 6,756,176, 6,780,500, 6,830,860, and 7,029,817, and U.S. Patent Publication No. 2008/0107989, the disclosures of which are totally incorporated herein by reference.

Polyester EA ultra low melt (ULM) toners have been prepared utilizing amorphous and crystalline polyester resins as disclosed in, for example, U.S. Pat. No. 7,547,499 and U.S. Patent Publication 2011/0097664, the disclosures of each of which are totally incorporated herein by reference. Advantages of these toners include small particle size, the ability to control particle size, shape, and morphology, the ability to incorporate a wax into the particles, low fusing temperature, and the like.

While known materials are suitable for their intended purposes, a need remains for improved carrier compositions. In addition, a need remains for improved developer compositions. Further, a need remains for carriers with desirable triboelectric charging characteristics and desirable conductivity characteristics. In order for desired xerographic development to occur developers must have a certain level of Tribo and Conductivity values. For example: For example when Tribo is too high not enough toner will transfer via electrostatics to the charged latent image or the development system controls may over compensate by raising the TC too high resulting in other failures. Also too low of Tribo and too much toner will transfer to the charged latent image or the development system may over compensate by lowering TC too low to raise the tribo resulting in other failures. Another example could be if the conductivity is too high then voltage breakdown may occur marring the image. Also when conductivity is too low the electric field necessary to transfer the toner might not be able to be achieved.

SUMMARY

Disclosed herein is a powder coated carrier for an electrophotographic developer comprising: (a) a ferrite core; and (b) a coating comprising: (i) a copolymer of cyclohexylmethacrylate and dimethylaminoethylmethacrylate, wherein the copolymer contains from about 0.8 to about 1.0 wt % dimethylaminoethylmethacrylate; (ii) a melamine-formaldehyde resin; and (iii) carbon black present in an amount of from about 9.2 to about 9.7 wt % of the coating; said coating being present in an amount of from about 0.85 to about 1.25 wt % of the carrier; said coated carrier having a conductivity of from about 8.9 to about 9.5 [log(mho/cm)].

Also disclosed herein is a developer composition comprising: (a) an emulsion aggregation toner comprising: (i) an amorphous polyester resin; (II) a crystalline polyester resin; (iii) a wax; and (iv) a colorant; and (b) a powder coated carrier comprising (i) a ferrite core; and (ii) a coating comprising: (A) a copolymer of cyclohexylmethacrylate and dimethylaminoethylmethacrylate, wherein the copolymer contains from about 0.8 to about 1.0 wt % dimethylaminoethylmethacrylate; (B) a melamine-formaldehyde resin; and (C) carbon black present in an amount of from about 9.2 to about 9.7 wt % of the coating; said coating being present in an amount of from about 0.85 to about 1.25 wt % of the carrier; said coated carrier having a conductivity of from about 8.9 to about 9.5 [Log(mho/cm)].

Also disclosed herein is a carrier or developer as described above, further comprising (a) a mixture of iron oxide, manganese oxide, lithium oxide; (b) a mixture of iron oxide, manganese oxide, magnesium oxide, and strontium oxide; (c) a mixture of iron oxide, manganese oxide, magnesium oxide, and calcium oxide; or (d) a mixture thereof.

Further disclosed herein is a carrier for an electrophotographic developer made by a process which comprises: (a) preparing a latex copolymer of cyclohexylmethacrylate and dimethylaminoethylmethacrylate, wherein the copolymer contains from about 0.8 to about 1.2 wt % dimethylaminoethylmethacrylate; (b) preparing dry particles of the copolymer having a particle size of from about 80 to about 120 nm; (c) preparing a carrier coating by mixing the dry copolymer particles with: (i) carbon black, present in an amount of from about 9.2 to about 9.7 wt % of the carrier coating; and (ii) a melamine-formaldehyde resin; (d) mixing the carrier coating with ferrite cores; (e) heating the mixture of carrier coating and ferrite cores at a temperature of from about 385 to about 405° F. for a period of from about 20 to about 30 minutes, thereby fusing the carrier coating to the ferrite core; and (f) screening the coated carrier particles; said coated carrier particles having: (1) a coating weight of from about 0.85 to about 1.25 wt %; and (2) a conductivity of from about 8.9 to about 9.5 [Log(mho/cm)].

DETAILED DESCRIPTION

Figure 1:
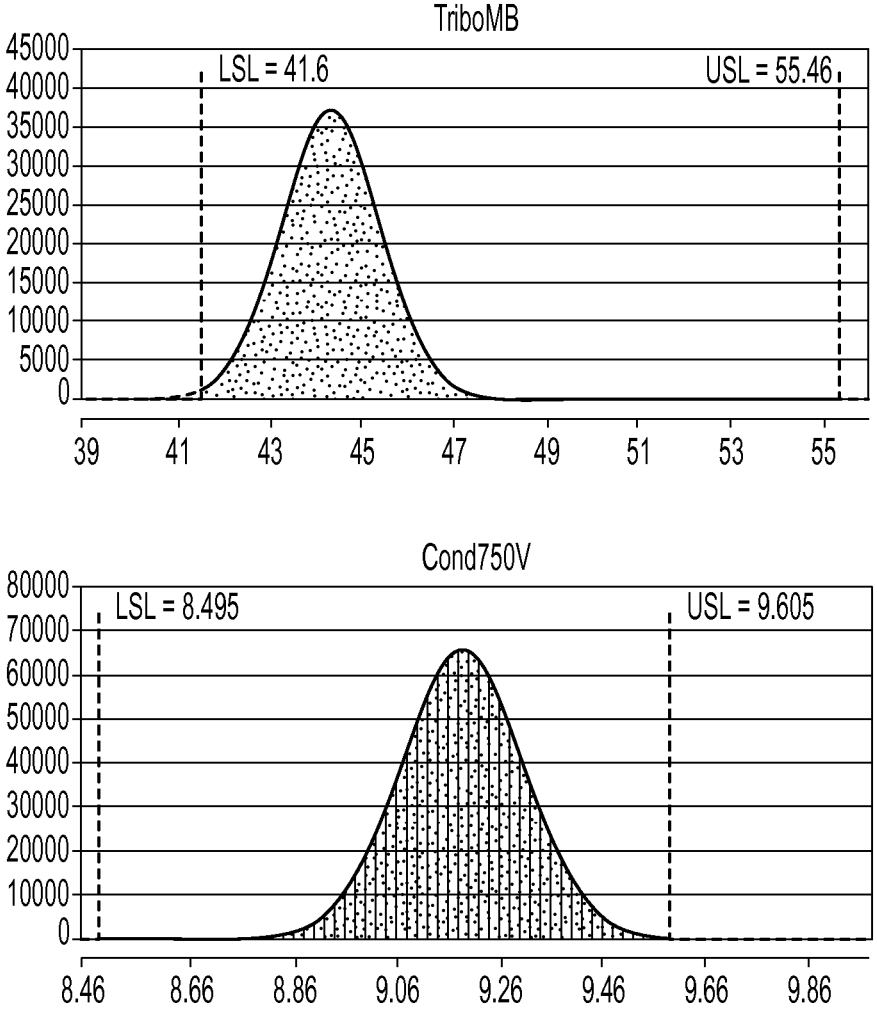
FIG. 1 represents data generated from a Monte Carlo EVA (Estimated Value Analysis) optimization for tribo and conductivity vs. coating weight and amount of carbon black in the carrier coating based on the design of experiments (DOE) predicted output from the carriers prepared in Example II.

The present embodiments provide improved carrier compositions that have desirable triboelectric charging characteristics and desirable conductivity characteristics. In order for desired xerographic development to occur, developers must have a certain level of triboelectric charging and conductivity values. For example when the triboelectric charge is too high, not enough toner will transfer via electrostatics to the charged latent image or the development system controls may over compensate by raising the triboelectric charge too high resulting in other failures. Too low of triboelectric charge and too much toner will transfer to the charged latent image or the development system may over compensate by lowering triboelectric charge too low resulting in other failures. Another example is if the conductivity is too high and results in a voltage breakdown that may occur marring the image. In addition, when conductivity is too low the electric field necessary to transfer the toner might not be able to be achieved.

The carrier disclosed herein has a ferrite core. The ferrite core comprises iron oxide ($Fe_2O_3$) as well as other materials, which may include oxides of metals such as lithium, manganese, magnesium, strontium, calcium, or the like, as well as mixtures thereof. In one specific embodiment, the carrier comprises a mixture of iron oxide, manganese oxide, magnesium oxide, and strontium oxide. In another specific embodiment, the carrier comprises a mixture of iron oxide, manganese oxide, magnesium oxide, and calcium oxide. In another specific embodiment, the carrier comprises a mixture of iron oxide, lithium oxide and manganese oxide.

The carrier core has an average particle diameter when measured by laser diffraction of, in one embodiment, at least about 20 μm, in another embodiment at least about 25 μm, and in yet another embodiment at least about 30 μm, and in one embodiment no more than about 55 μm, in another embodiment no more than about 50 μm, and in yet another embodiment no more than about 45 μm.

The carrier core has a conductivity at 500 v DC of in one embodiment at least about 6.25 [log(mho/cm)], in another embodiment at least about 7.00 [log(mho/cm)], and in yet another embodiment at least about 7.25 [log(mho/cm)], and in one embodiment no more than about 9.50 [log(mho/cm)], in another embodiment no more than about 8.75 [log(mho/cm)], and in yet another embodiment no more than about 8.50 [log(mho/cm)].

The carrier core has a surface roughness, as measured by the BET (Brunauer Emmett Teller) method, of in one embodiment at least about 0.153 $m^2/g$, in another embodiment at least about 0.158 $m^2/g$, and in yet another embodiment at least about 0.163 $m^2/g$, and in one embodiment no more than about 0.177 $m^2/g$, in another embodiment no more than about 0.172 $m^2/g$, and in yet another embodiment no more than about 0.167 $m^2/g$.

Examples of suitable carrier cores include those available from Powdertech Co., Ltd, Japan, and those available from Dowa Electronics Materials Co., Ltd., Japan.

The carrier coating comprises a latex comprising a copolymer of cyclohexylmethacrylate and dimethylaminoethylmethacrylate. The ratio of cyclohexylmethacrylate monomer to dimethylaminoethylmethacrylate monomer is in one embodiment at least about 99.5:0.5, in another embodiment at least about 99.35:0.65, and in yet another embodiment at least about 99.2:0.8, and in one embodiment no more than about 98.5:1.5, in another embodiment no more than about 98.65:1.35, and in yet another embodiment no more than about 98.8:1.2. The carrier copolymer is, in one specific embodiment, prepared by a process entailing the use of sodium lauryl sulfate as a surfactant, and can be prepared as described in, for example, U.S. Pat. No. 8,354,214, the disclosure of which is totally incorporated herein by reference.

When prepared and dried, the carrier coating copolymer has an average particle diameter of in one embodiment at least about 65 nm, in another embodiment at least about 72.5 nm, and in yet another embodiment at least about 80 nm, and in one embodiment no more than about 145 nm, in another embodiment no more than about 132.5 nm, and in yet another embodiment no more than about 120 nm.

The carrier coating further comprises a conductive agent which is carbon black. Carbon black is present in the polymeric coating in an amount of in one embodiment at least about 7.5 percent by weight (wt %), in another embodiment at least about 8.5 wt %, and in yet another embodiment at least about 9.2 wt %, and in one embodiment no more than about 11.5 wt %, in another embodiment no more than about 10.5 wt %, and in yet another embodiment no more than about 9.7 wt %. Examples of suitable carbon black include Vulcan 72R, available from Cabot Corporation Worldwide, or the like. The carbon black is dry-blended with the carrier coating copolymer prior to powder coating of the carrier.

The carrier coating also comprises a melamine formaldehyde resin (hereinafter referred to as melamine). The melamine is present in the polymeric coating in an amount of in one embodiment at least about 8 wt %, in another embodiment at least about 9 wt %, and in yet another embodiment at least about 9.8 wt %, and in one embodiment no more than about 12 wt %, in another embodiment no more than about 11 wt %, and in yet another embodiment no more than about 10.2 wt %. Examples of suitable melamines include EPOSTAR S, available from Nippon Shokubai Co., LTD, Osaka, Japan, or the like. The melamine formaldehyde resin is dry-blended with the carrier coating copolymer prior to powder coating of the carrier.

In embodiments, the carrier coating has an average surface coverage over the carrier core of at least about 85%, in another embodiment at least about 90 wt %, and in yet another embodiment at least about 94 wt %.

The carrier coating is prepared by dry-mixing the polymeric coating material with the carbon black, the melamine formaldehyde resin, and any other desired additives, such as flow control agents, wear control agents, charge control agents, conductivity control agents, or the like to create a homogeneous mixture. Thereafter, this mixture is mixed with the carrier cores to distribute and attach the mixture mechanically to the core structure. The mixture with the cores is then subjected to a fusing step at elevated temperature, during which the coating becomes permanently adhered to the cores. Fusing can take place in a rotary furnace, extruder, melt mix kneading machine, or the like. In one specific embodiment, the fusing is in a rotary kiln. An example of a suitable rotary kiln is available from Harper Corporation (Lancaster, N.Y.).

Fusing occurs at any desired or effective temperature, in one embodiment at least about 350° F., in another embodiment at least about 375° F., and in another embodiment at least about 385° F., and in one embodiment no more than about 450° F., in another embodiment no more than about 425° F., and in yet another embodiment no more than about 405° F.

Fusing occurs for any desired or effective period of time, in one embodiment at least about 15 minutes, in another embodiment at least about 18 minutes, and in yet another embodiment at least about 20 minutes, and in one embodiment no more than about 50 minutes, in another embodiment no more than about 40 minutes, and in yet another embodiment no more than about 30 minutes.

The carrier coating is present on the core at a coating weight (expressed as a percent by weight of the carrier particle) of in one embodiment at least about 0.60 wt %, in another embodiment at least about 0.75 wt %, and in yet another embodiment at least about 0.85 wt %, and in one embodiment no more than about 1.50 wt %, in another embodiment no more than about 1.35 wt %, and in yet another embodiment no more than about 1.25 wt %.

Subsequent to coating, the carrier is screened to break up or remove any carrier particle agglomerates that may have occurred.

The carrier has a conductivity at 750 v DC of in one embodiment at least about 7.9 [log(mho/cm)], in another embodiment at least about 8.4 [log(mho/cm)], and in yet another embodiment at least about 8.9 [log(mho/cm)], and in one embodiment no more than about 10.5 [log(mho/cm)], in another embodiment no more than about 10.1 [log(mho/cm)], and in yet another embodiment no more than about 9.5 [log (mho/cm)].

In embodiments, the coated carrier exhibits a triboelectric (Q/m) at 8% Toner Concentration of at least about 32 micro-Coulombs/gram (μC/g), in another embodiment at least about 37 μC/g, and in yet another embodiment at least about 43 μC/g, and in one embodiment no more than about 57 μC/g, in another embodiment no more than about 55 μC/g, and in yet another embodiment no more than about 53 μC/g.

The coated carrier exhibits a triboelectric (Q/m) Charging Capability also known as $A_t$ which={Tribo [μC/g] multiplied by the sum of (Toner Concentration [TC] {%} added to $C_0$ [In this case=4])} or (Tribo×[TC+$C_0$]) of, in one embodiment, at least about 300 $A_t$, in another embodiment at least about 325 $A_t$, and in yet another embodiment at least about 350 $A_t$, and in one embodiment no more than about 700 $A_t$, in another embodiment no more than about 625 $A_t$, and in yet another embodiment no more than about 575 $A_t$.

The above At values were exhibited when the relative humidity is, in one embodiment, at least about 10% at a temperature of 70° F., in another embodiment at 50% at a temperature of 70° F., and in another embodiment at 80% at a temperature of 80° F.

The carrier is present in the developer in any desired or effective amount, in one embodiment at least about 86 wt %, in another embodiment at least about 88 wt %, and in yet another embodiment at least about 90 wt %, and in one embodiment no more than about 95 wt %, in another embodiment no more than about 93.5 wt %, and in yet another embodiment no more than about 92 wt %.

The carrier is suitable for use with an electrophotographic toner, in combination with which it comprises a developer. Any desired or effective toner can be used.

One specific example of a suitable toner is an emulsion aggregation ultra-low-melt toner, such as those described in, for example, U.S. Pat. No. 7,547,499 and U.S. Patent Publication 2011/0097664, which are hereby incorporated by reference. Another is an emulsion aggregation toner as described in U.S. Patent Publication 2011/0086301, which is hereby incorporated by reference. The toner comprises a mixture of an amorphous polyester and a crystalline polyester.

Any desired or suitable amorphous polyester can be used, such as those disclosed in the aforementioned references. Specific examples include those derived from the reaction of (a) an organic alcohol, such as propylene glycol, ethylene glycol, diethylene glycol, neopentyl glycol, dipropylene glycol, dibromoneopentyl glycol, alkoxylated bisphenol A diols, 2,2,4-trimethylpentane-1,3-diol, tetrabromo bisphenol dipropoxy ether, 1,4-butanediol, or mixtures thereof, and (b) an acid, such as succinic acid, glutaric acid, adipic acid, pimelic acid, suberic acid, azelaic acid, sebacic acid, isophthalic acid, terephthalic acid, hexachloro-endo-methylene tetrahydrophthalic acid, maleic acid, fumaric acid, chloromaleic acid, methacrylic acid, acrylic acid, itaconic acid, citraconic acid, mesaconic acid, maleic anhydride, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, or mixtures thereof. Specific examples of suitable amorphous resins include those disclosed in, for example, U.S. Patents the disclosures of each of which are totally incorporated herein by reference.

In one specific embodiment, the amorphous polyester is a poly(propoxylated bisphenol A co-fumarate) resin. In another specific embodiment, this resin is of the formula

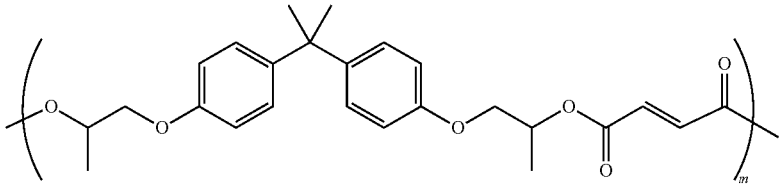

wherein m is from about 5 to about 1000. In another embodiment, the amorphous resin is terpoly-(propoxylated bisphenol A-fumarate)-terpoly(propoxylated bisphenol A-terephthalate)-terpoly-(propoxylated bisphenol A-2-dodecylsuccinate).

Any desired or suitable crystalline can be used, such as those disclosed in the aforementioned references. Specific examples include those derived from the reaction of (a) an alcohol component comprising 80% by mole or more of an aliphatic diol or triol or higher having 2 to 6 carbon atoms, such as ethylene glycol, 1,2-propylene glycol, 1,3-propylene glycol, 1,4-butanediol, 1,5-pentanediol, 1,6-hexanediol, neopentyl glycol, 1,4-butanediol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, or mixtures thereof; and (b) a carboxylic acid component comprising 80% by mole or more of an aliphatic dicarboxylic acid or tricarboxylic acid or higher having 2 to 8 carbon atoms, such as oxalic acid, malonic acid, maleic acid, fumaric acid, citraconic acid, itaconic acid, glutaconic acid, succinic acid, adipic acid, acid anhydrides thereof, glutaric acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, mesaconic acid, a diester or anhydride thereof, alkyl (1 to 3 carbon atoms) esters thereof, 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, acid anhydrides thereof, alkyl (1 to 3 carbon atoms) esters thereof, or mixtures thereof. The alcohol component can include a polyhydric alcohol component in addition, and the acid component can contain a polycarboxyl component in addition. Examples of such materials are disclosed in, for example, U.S. Pat. Nos. 7,329,476 and 6,780,557 and U.S. Patent Publication 2006/0222991, the disclosure of which is totally incorporated herein by reference.

In one specific embodiment, the crystalline resin is derived from ethylene glycol and a mixture of dodecanedioic acid and fumaric acid co-monomers. In another specific embodiment, the crystalline resin is of the formula

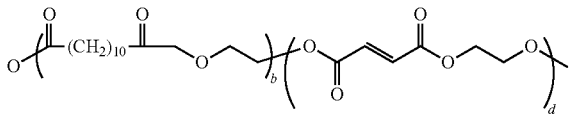

wherein b is from about 5 to about 2000 and d is from about 5 to about 2000. In another specific embodiment, the crystalline resin is poly(nonane-dodecanoiate).

The amorphous resin and the crystalline resin are present in any desired or effective amounts. In one embodiment, the amorphous resin is present in the toner in an amount, by weight, of in one embodiment at least about 40 wt %, in another embodiment at least about 50 wt %, and in yet another embodiment at least about 60 wt %, and in one embodiment no more than about 70 wt %, in another embodiment no more than about 80 wt %, and in yet another embodiment no more than about 90 wt %.

In one embodiment, the crystalline resin is present in the toner in an amount, by weight, of in one embodiment at least about 2 wt %, in another embodiment at least about 5 wt %, and in yet another embodiment at least about 10 wt %, and in one embodiment no more than about 20 wt %, in another embodiment no more than about 25 wt %, and in yet another embodiment no more than about 30 wt %.

The toner can also contain a wax. Examples of suitable waxes include natural vegetable waxes, such as carnauba wax, candelilla wax, rice wax, sumacs wax, jojoba oil, Japan wax, and bayberry wax; natural vegetable waxes, such as beeswax, Punic wax, lanolin, lac wax, shellac wax, and spermaceti wax; mineral waxes, such as paraffin wax, microcrystalline wax, montan wax, ozokerite wax, ceresin wax, petrolatum wax, and petroleum wax; synthetic waxes and functionalized waxes, such as Fischer-Tropsch wax, acrylate wax, fatty acid amide wax, silicone wax, polytetrafluoroethylene wax, polyethylene wax, ester waxes obtained from higher fatty acid and higher alcohol, such as stearyl stearate and behenyl behenate, ester waxes obtained from higher fatty acid and monovalent or multivalent lower alcohol, such as butyl stearate, propyl oleate, glyceride monostearate, glyceride distearate, and pentaerythritol tetra behenate, ester waxes obtained from higher fatty acid and multivalent alcohol multimers, such as diethyleneglycol monostearate, dipropyleneglycol distearate, diglyceryl distearate, and triglyceryl tetrastearate, sorbitan higher fatty acid ester waxes, such as sorbitan monostearate, and cholesterol higher fatty acid ester waxes, such as cholesteryl stearate, polypropylene wax; and the like, as well as mixtures thereof. Examples include those disclosed in British Patent 1,442,835, the disclosure of which is totally incorporated herein by reference.

Specific examples include polypropylenes and polyethylenes, particularly those of low molecular weight, such as polyethylenes of Mw from about 500 to about 2,000, or in another embodiment from about 1,000 to about 1,500, and polypropylenes of Mw from about 1,000 to about 10,000.

The wax is present in the toner in any desired or suitable amount, in one embodiment at least about 1 wt %, in another embodiment at least about 3 wt %, and in yet another embodiment at least about 5 wt %, and in one embodiment no more than about 25 wt %, in another embodiment no more than about 15 wt %, and in yet another embodiment no more than about 11 wt %.

Any desired or suitable colorant can be used in the toner, such as dyes, pigments, or mixtures thereof. The colorant is present in the toner in any desired or suitable amount, in one embodiment at least about 0.1 wt %, in another embodiment at least about 1 wt %, and in yet another embodiment at least about 2 wt %, and in one embodiment no more than about 35 wt %, in another embodiment no more than about 25 wt %, and in yet another embodiment no more than about 12 wt %.

In some embodiments, a shell can be formed over the toner particles. In one embodiment, the shell comprises the same amorphous resin or resins that are found in the core. For example, if the core comprises one, two, or more amorphous resins and one, two, or more crystalline resins, in this embodiment the shell will comprise the same amorphous resin or mixture of amorphous resins found in the core. In some embodiments, the ratio of the amorphous resins can be different in the core than in the shell.

The toner can contain optional additives as desired, such as charge control agents, flow aid additives, or the like.

The toner particles have a circularity of in one embodiment at least about 0.920, in another embodiment at least about 0.940, in yet another embodiment at least about 0.962, and in still another embodiment at least about 0.965, and in one embodiment no more than about 0.999, in another embodiment no more than about 0.990, and in yet another embodiment no more than about 0.980, although the value can be outside of these ranges. A circularity of 1.000 indicates a completely circular sphere. Circularity can be measured with, for example, a Sysmex FPIA 2100 analyzer.

Emulsion aggregation processes provide greater control over the distribution of toner particle sizes and can limit the amount of both fine and coarse toner particles in the toner. The toner particles can have a relatively narrow particle size distribution with a lower number ratio geometric standard deviation (GSDn) of in one embodiment at least about 1.15, in another embodiment at least about 1.18, and in yet another embodiment at least about 1.20, and in one embodiment no more than about 1.40, in another embodiment no more than about 1.35, in yet another embodiment no more than about 1.30, and in still another embodiment no more than about 1.25.

The toner particles can have a volume average diameter (also referred to as "volume average particle diameter" or "$D_{50v}$") of in one embodiment at least about 3 μm, in another embodiment at least about 4 μm, and in yet another embodiment at least about 5 μm, and in one embodiment no more than about 25 μm, in another embodiment no more than about 15 μm, and in yet another embodiment no more than about 12 μm. $D_{50v}$, GSDv, and GSDn can be determined using a measuring instrument such as a Beckman Coulter Multisizer 3, operated in accordance with the manufacturer's instructions. Representative sampling can occur as follows: a small amount of toner sample, about 1 g, can be obtained and filtered through a 25 μm, then put in isotonic solution to obtain a concentration of about 10%, with the sample then run in a Beckman Coulter Multisizer 3.

The toner particles can have a shape factor of in one embodiment at least about 105, and in another embodiment at least about 110, and in one embodiment no more than about 170, and in another embodiment no more than about 160, SF1*a. Scanning electron microscopy (SEM) can be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

The characteristics of the toner particles may be determined by any suitable technique and apparatus and are not limited to the instruments and techniques indicated hereinabove.

The developer exhibits a triboelectric (Q/m) at 8% Toner Concentration of in one embodiment at least about 32 microCoulombs/gram (μC/g), in another embodiment at least about 37 μC/g, and in yet another embodiment at least about 43 μC/g, and in one embodiment no more than about 57 μC/g, in another embodiment no more than about 55 μC/g, and in yet another embodiment no more than about 53 μC/g.

The developer exhibits a triboelectric (Q/m) Charging Capability exhibits a triboelectric (Q/m) Charging Capability also known as $A_t$ which={Tribo [μC/g] multiplied by the sum of (Toner Concentration [TC] {%} added to $C_0$ [In this case=4])} or (Tribo×[TC+$C_0$]) of in one embodiment at least about 300 $A_t$, in another embodiment at least about 325 $A_t$, and in yet another embodiment at least about 350 $A_t$, and in one embodiment no more than about 700 $A_t$, in another embodiment no more than about 625 $A_t$, and in yet another embodiment no more than about 575 $A_t$.

The above At values were exhibited when the relative humidity of in one embodiment at least about 10% at a temperature of 70 deg F., in another embodiment at 50% at a temperature of 70 deg F., and in another embodiment at 80% at a temperature of 80 deg F.

Specific embodiments will now be described in detail. These examples are intended to be illustrative, and the claims are not limited to the materials, conditions, or process parameters set forth in these embodiments. All parts and percentages are by weight unless otherwise indicated.

Example I

Experiments were performed to determine the optimum amount of dimethylaminoethylmethacrylate (DMAEMA) level in the sodium lauryl sulfate polymerized cyclohexylmethacrylate-dimethylaminoethylmethacrylate (SLS CHMA-DMAEMA) copolymer. 0.0 wt %, 0.5 wt %, and 1.0 wt % DMAEMA was copolymerized with SLS CHMA. Subsequent to polymerization, particles of the polymers were then incorporated into premixes comprising 10 wt % EPOSTAR S melamine formaldehyde resin, 11.25 wt % VULCAN 72R carbon black, and 78.75 wt % of the polymer. Each of these premixes was then incorporated into a mix comprising 1.20 wt % of the premix and 98.8 wt % of EMC-1010 Li Mn Ferrite Core (obtained from Powdertech Co., Ltd, Japan). The three mixes were fused in an electric rotary furnace at 390° F. with a residence time of ~30 min followed by screening with a 165 Tensile Bolting Cloth (TBC) screen (~106 μm) on a vibrating screener. These carriers and a XEROX® 700 carrier (The Control) were then each mixed with XEROX® 700 magenta toner in relative amounts of 8 parts by weight of 100 parts of toner. Blowoff triboelectric measurements were performed and the results were compared to a XEROX® 700 control carrier prepared by solution coating methods having the desired tribo charging value, as described in U.S. Patent Publication 2008/0056769, which is hereby incorporated by reference. The results are shown in Table 1.

TABLE 1

| Carrier ID | 1 | 2 | 3 | XEROX ® 700 control carrier |
|---|---|---|---|---|
| Carrier Description | 0% DMAEMA | 0.5% DMAEMA | 1.0% DMAEMA | Solution Coated |
| Tribo μC/g | 39.62 μC/g | 48.44 μC/g | 55.02 μC/g | 53.65 μC/g |

As the first series of carriers showed that tribo and conductivity were close with 1% DMAEMA copolymerized with SLS CHMA, that design was chosen to move on.

Example II

A 2×2 Design of Experiment (DOE) using coating wt % and carbon black % was run to explore the design space critical parameters for triboelectric charge and conductivity for this type of carrier. Table 2 below shows the experimental factors and levels used.

TABLE 2

| | Factors | Low | High |
|---|---|---|---|
| a | Coating wt % | 0.8 | 1.6 |
| b | Carbon Black % | 8.25 | 14.25 |

1.0% DMAEMA was copolymerized with SLS CHMA by the process described in Example I. The dry polymer was then incorporated into 2 premixes comprising 10 wt % EPOSTAR S melamine formaldehyde resin. One premix comprised 8.25 wt % VULCAN 72R carbon black (obtained from Cabot Corp, Worldwide) and the other premix comprised 14.25 wt % carbon black. The remainder of the premixes comprised the dry SLS CHMA-DMAEMA. Each of these premixes was then incorporated into two mixes to make a total of four mixes. The two mixes for each premix comprised 0.8 wt % premix and 1.6 wt % premix, respectively, and the remainder EMC-1010 Li Mn Ferrite Core (Powdertech Co., Ltd.). Each of the four resulting mixes was then fused in an electric rotary furnace at 400° F. with a residence time of ~30 min followed by screening with a 165 TBC (~106 μm) screen on a vibrating screener. The four carriers were then each mixed with XEROX® 700 magenta toner in relative amounts of 8 parts by weight of 100 parts of toner. Blowoff triboelectric measurements were performed at 70° F. and 50% relative humidity (RH). Each carrier was also measured for conductivity (mho/cm) in a magnetic brush at 750 v DC. A statistical regression analysis of the resulting data was performed and the main drivers were determined to be as shown in Table 3

TABLE 3

| Property | Main Driver(s) |
|---|---|
| For Tribo in 70° F. @50% RH | Coating Weight (+), Carbon Black % (−) |
| For Conductivity | Coating Weight (+), Carbon Black (−) |

This DOE showed that a carrier could be made with this material set that would satisfy the desired values for tribo and conductivity based on the specification limits for the XEROX® 700 carrier (The Control). An optimized Monte Carlo EVA analysis showed that the design needed to be further optimized for variability to move the Tribo and Conductivity to the center of the desired range defined by the XEROX® 700 carrier (The Control). The data are also shown in FIG. 1.

In FIG. 1, the X axis is Tribo for the Upper graph and Conductivity for the Lower graph. The Y axis are the number of times out of the simulation (1 million simulations in this case) that a tribo and conductivity were predicted based upon the variation for the input parameters (in this case standard deviation for weight of the input of Coating Weight and Carbon Black) and the measurement noise (in this case the standard deviation of the Tribo and Conductivity measurements) Any simulations falling outside of the upper or lower specification is considered a defect (in other words scrap would be produced and is not desirable). A summary of the data is provided in Table 4 below.

TABLE 4

| | Tribo (Magenta Toner measured in BZone (70 deg F. and 50% RH)) | Cond750V |
|---|---|---|
| | Process Outputs | |
| # Simulations | 1,000,000 | 1,000,000 |
| Mean | 44.43188248 | 9.204452652 |
| StdDev | 1.072851752 | 0.121687826 |
| Median | 44.43201078 | 9.204557429 |
| LSL | 41.6 | 8.495 |
| USL | 55.46 | 9.605 |
| | Normal Distro Statistics | |
| KS Test p-Value (Normal) | Not available | Not available |
| dpm | 4,150 | 498 |
| Cpk | 0.88 | 1.097 |
| Cp | 2.153 | 1.52 |
| | Observed Defect Statistics | |
| Simulations outside of spec | 4,055 | 514 |
| Observed dpm | 4,055 | 514 |

These high defect rates and low Cpks were not desirable.

Example II Continued

To confirm the data, a center point confirmation was run for the 2×2 DOE. A premix comprising 10 wt % EPOSTAR S melamine formaldehyde resin, 11.25 wt % VULCAN 72R carbon black, and the remainder the dry SLS CHMA-DMAEMA. The premix was then incorporated into a mix comprising 1.2 wt % of the premix and the remainder EMC-1010 Li Mn Ferrite Core. The mix was fused in an electric rotary furnace at 400° F. with a residence time of ~30 min followed by screening with a 165 TBC (~106 μm) screen on a vibrating screener. The carrier was mixed with XEROX® 700 magenta toner in relative amounts of 8 parts by weight to 100 parts toner. Blowoff triboelectric measurements were performed at 70° F. and 50% relative humidity (RH) and the results were compared to the predicted value from the DOE. Each carrier was also measured for conductivity (mho/cm) in a magnetic brush at 750 v DC the results were compared to the predicted value from the DOE. Results for the confirmation run are shown in Table 5 below.

TABLE 5

| | | | |
|---|---|---|---|
| Predicted Tribo @70° F., 50% RH | 56.61 μC/g | Actual Tribo @70° F., 50% RH | 60.11 μC/g |
| Predicted conductivity @750 V | 10.14 [mho/cm] | Actual conductivity @750 V | 10.27 ]mho/cm] |

Figure 2:
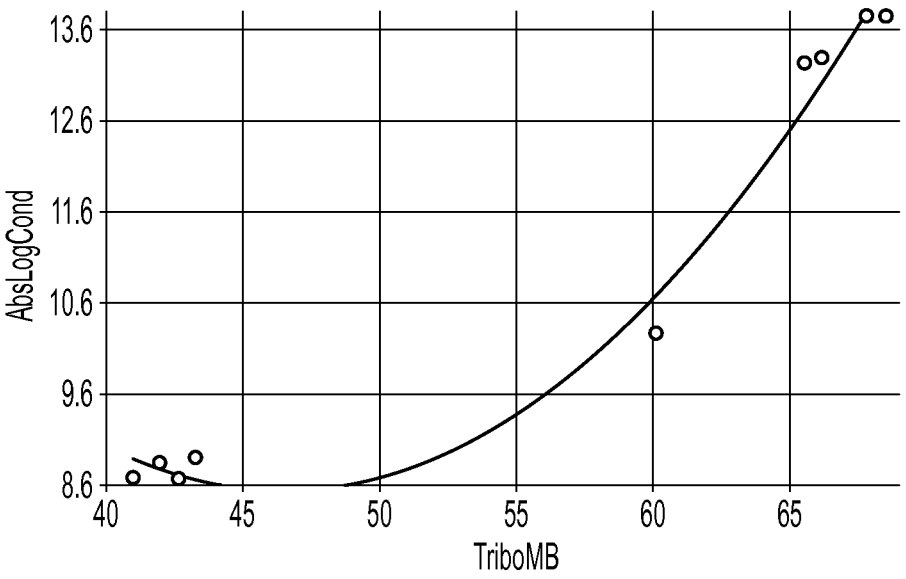
FIG. 2 represents data generated for conductivity and tribo for carriers prepared in Example II.

These results confirm the validity of the DOE. Next a regression analysis of tribo vs. conductivity was conducted to see if that relationship could be used to tie the parameters of tribo and conductivity to the Carriers Main Drivers. The regression showed an expected relationship between tribo and conductivity. In this case, however, it appeared that the relationship might have curvature. The results are shown in Table 6 below and in FIG. 2.

TABLE 6

Regression Analysis - Polynomial Fit, $2^{nd}$ Order
AbsLogCon = 0.011554 * TriboMB2 − 1.0744 * TriboMB + 33.516

| | Coeff. | t-Statistic | p-Value | Tolerance |
|---|---|---|---|---|
| Const | 33.516 | 4.554 | 0.004 | |
| TriboMB | −1.0744 | −3.7913 | 0.009 | 0.0012625 |
| $TriboMB^2$ | 0.011554 | 4.4402 | 0.004 | 0.0012625 |
| Count | $R^2$ | Adj $R^2$ | F | Std Error |
| 9 | 0.98316 | 0.97755 | 175.175 | 0.35806 |

Example III

Knowing that coating wt % and carbon black % are main drivers from the DOE above, that fuse temperature of the coating onto the core is a main driver from previous powder coating experience with similar carrier for tribo and conductivity at 70° F. and 50% RH (important parameters for xerographic development) and that there may be curvature also in the design, a central composite design DOE was chosen to optimize the design. The outer array range was chosen as follows:

coating weight: 0.8-1.6 wt %
carbon black: 8.25-14.25 wt %
temperature: 350-450° F.

Alpha for the design was set at 1.68. Table 7 shows the entire design with center points.

TABLE 7

| | Factor | | |
|---|---|---|---|
| Carrier# | A Coating wt % | B Carbon Black % | C Temp° F. |
| 1 | 0.96 | 9.46 | 370.24 |
| 2 | 0.96 | 9.46 | 429.76 |
| 3 | 0.96 | 13.04 | 370.24 |
| 4 | 0.96 | 13.04 | 429.76 |
| 5 | 1.44 | 9.46 | 370.24 |
| 6 | 1.44 | 9.46 | 429.76 |
| 7 | 1.44 | 13.04 | 370.24 |
| 8 | 1.20 | 13.04 | 429.76 |
| 9 | 1.20 | 11.25 | 400.00 |
| 10 | 1.20 | 11.25 | 400.00 |
| 11 | 1.20 | 11.25 | 400.00 |
| 12 | 1.20 | 11.25 | 400.00 |
| 13 | 1.20 | 11.25 | 400.00 |
| 14 | 1.20 | 11.25 | 400.00 |
| 15 | 0.80 | 11.25 | 400.00 |

TABLE 7-continued

| | Factor | | |
|---|---|---|---|
| Carrier# | A Coating wt % | B Carbon Black % | C Temp° F. |
| 16 | 1.60 | 11.25 | 400.00 |
| 17 | 1.20 | 8.25 | 400.00 |
| 18 | 1.20 | 14.25 | 400.00 |
| 19 | 1.20 | 11.25 | 350.00 |
| 20 | 1.20 | 11.25 | 450.00 |

The process used to make the polymeric carrier coating for this DOE was at the 100 gal pilot scale and drying of the polymer was at the manufacturing scale. All processes used for the carrier premix, mix, coating fuse, and screen were at a laboratory scale level with equipment that is directly scalable to pilot scale equipment and then to manufacturing scale equipment. 1.0 wt % DMAEMA was copolymerized with sodium lauryl sulfate surfactant and CHMA monomer to form a latex. The dry polymer thus formed was then incorporated into 20 premixes. Each premix comprised 10.0 wt % EPOSTAR S melamine and VULCAN 72R carbon black at the wt % indicated in the table above, with the remainder of the premix comprising the dry SLS CHMA-DMAEMA. Each premix was then incorporated into a mix comprising the wt % coating listed in the table above of the premix and the remainder being EMC-1010 Li Mn ferrite core. The resulting mixes were then fused in an electric rotary furnace at the temperatures listed in the table above with a residence time of ~30 min followed by screening of the fused carriers with a 165 TBC (~106 μm) screen on a vibrating screener. The resulting 20 carriers were then mixed with XEROX® 700 yellow toner in relative amounts of 8 parts by weight to 100 parts toner. Blowoff triboelectric measurements were performed at 70° F. and 50% relative humidity (RH). Each carrier was also measured for conductivity (mho/cm) in a magnetic brush at 750 v DC. A statistical regression analysis of the resulting data was performed and the main drivers were determined to be as follows in Table 8.

TABLE 8

| Property | Main Driver(s) |
|---|---|
| For Tribo in 70° F. @50% RH | Coating Weight % (+), Carbon Black % (−), Temperature (−) |
| For Conductivity | Coating Weight % (+), Carbon Black % (−), Temperature (−) |

All of the curvature interactions were small but statistically significant for tribo, coating weight %, and temperature.

This DOE showed that a carrier could be made with this material set that would satisfy the desired values for tribo and conductivity based on the specification limits for the XEROX® 700 carrier (The Control). An optimized Monte Carlo EVA analysis showed that the design could be optimized for variability to the center of the required design space. Further charts are shown in FIG. 3.

Figure 3:
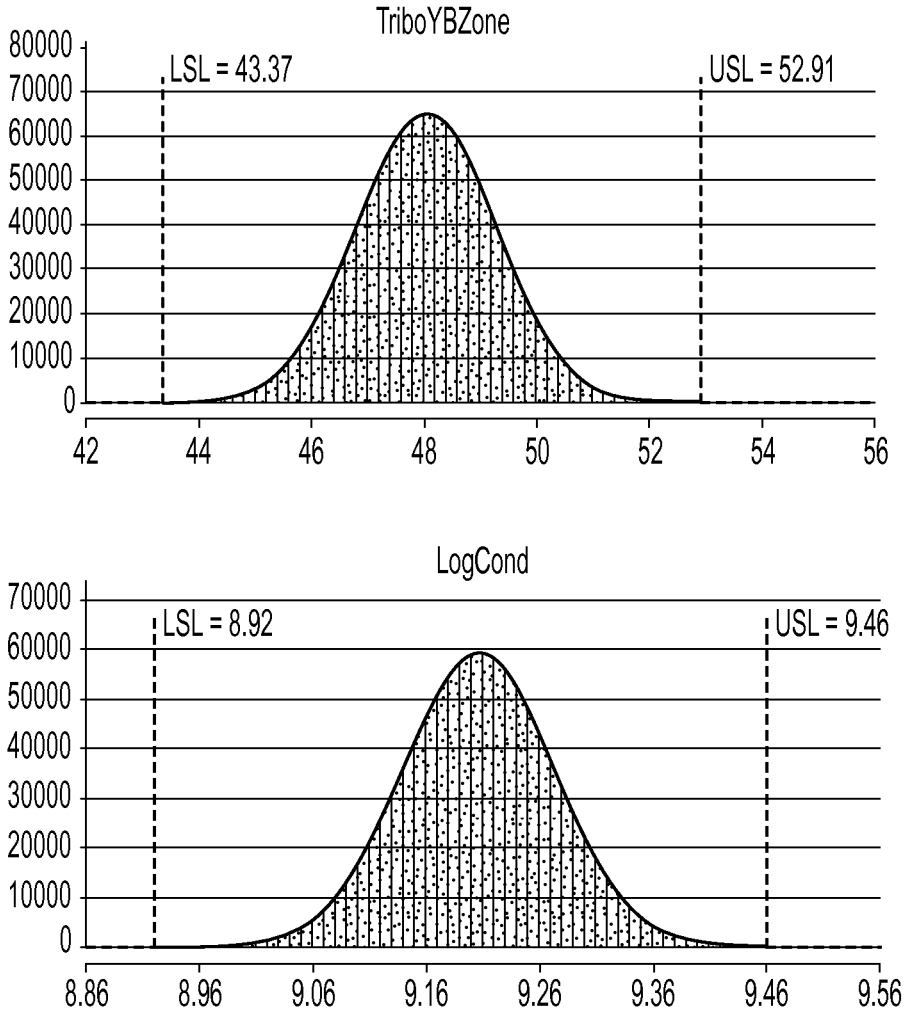
FIG. 3 represents data generated from a Monte Carlo EVA optimization for tribo and conductivity vs. coating weight, amount of carbon black in the carrier coating and temperature based on the DOE predicted output from the carriers prepared in Example III.

In FIG. 3, the X axis is Tribo for the Upper graph and Conductivity for the Lower graph. The Y axis are the number of times out of the simulation (1 million simulations in this case) that a tribo and conductivity were predicted based upon the variation for the input parameters (in this case standard deviation for weight of the input of Coating Weight and Carbon Black; and the process temperature used) and the measurement noise (in this case the standard deviation of the Tribo and Conductivity measurements) Any simulations falling outside of the upper or lower specification is considered a defect (in other words scrap would be produced and is not desirable). A summary of the data is provided in Table 9 below.

TABLE 9

| | Tribo (Yellow Toner measured in BZone (70 deg F. and 50% RH)) | LogCond |
|---|---|---|
| Process Outputs | | |
| #Simulations | 1,000,000 | 1,000,000 |
| Mean | 48.02484936 | 9.206682052 |
| StdDev | 1.224596023 | 0.067376219 |
| Median | 48.02502731 | 9.206550352 |
| LSL | 43.37 | 8.92 |
| USL | 52.91 | 9.46 |
| Normal Distro Statistics | | |
| KS Test p-Value (Normal) | not available | not available |
| dpm | 105 | 95 |
| Cpk | 1.267 | 1.253 |
| Cp | 1.298 | 1.336 |
| Observed Defect Statistics | | |
| Simulations outside of spec | 93 | 95 |
| Observed dpm | 93 | 95 |

Regression analysis Tribo vs. Conductivity again shows a nonlinear relationship between tribo and conductivity as indicated in the table below and FIG. 4.

Figure 4:
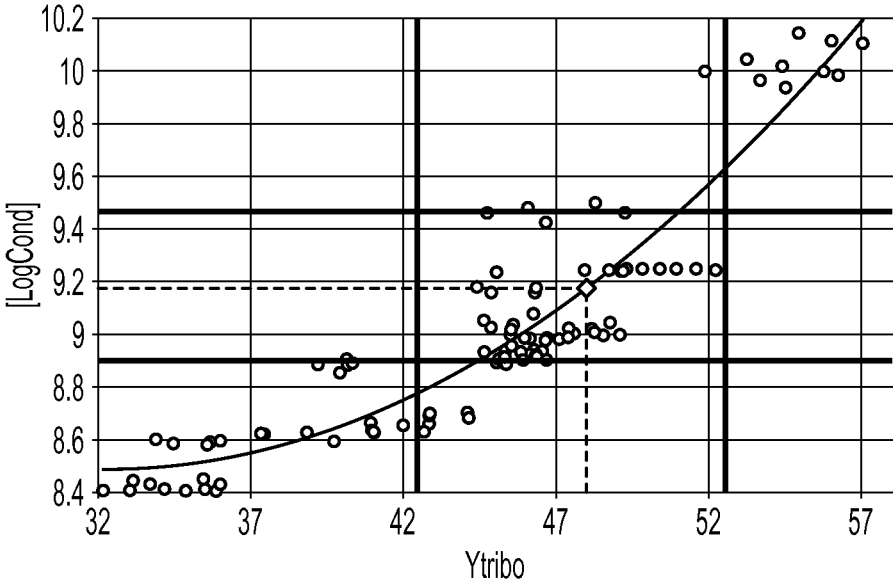
FIG. 4 represents data generated for tribo vs. conductivity for carriers prepared in Example III.

The box defined on the curve in FIG. 4 for a tribo of 43 to 53 and a conductivity of 8.92 to 9.46 represented the preferred functional performance range for this powder coated carrier design.

Example III Continued

A confirmation run for the DOE of Example IV was made using the formulation and processing outputs predicted by the Monte Carlo EVA to produce a carrier that would be at the tribo and conductivity values desired. The process above was repeated to obtain a carrier having 9.60 wt. % VULCAN 72R carbon black in the carrier coating. The coating was fused at 394.4° F. and the coating weight was 1.22 wt. %. A yellow developer was formed by the described method. Results for the confirmation run are shown in Table 10.

TABLE 10

| | | | |
|---|---|---|---|
| predicted tribo 70° F. 50% RH | 48.15 μC/g | actual tribo 70° F. | 50.41 μC/g |
| predicted conductivity 750 V | 9.19 [mho/cm] | actual conductivity 750 v | 9.31 [mho/cm] |

These results confirmed the validity of the DOE. These results also confirmed that a good match to the desired characteristics of the carrier could be made using a pilot scale polymer with a laboratory scale carrier. The next carrier made was a scale-up to the pilot scale carrier mixing and fusing process equipment.

Example IV

A pilot scale carrier was prepared of the composition described in the confirmation run in Example III using the times, temperatures, and relative amounts described therein. A yellow developer was formed by the described method. Results for the carrier are shown in Table 11 below.

TABLE 11

| | | | |
|---|---|---|---|
| predicted tribo 70° F. 50% RH | 48.15 μC/g | actual tribo 70° F. | 53.13 μC/g |
| predicted conductivity 750 V | 9.19 [mho/cm] | actual conductivity 750 v | 9.24 [mho/cm] |

A small increase in tribo is evident from the results and is not out of line with past experience of the scale-up between lab and pilot scale equipment.

Example V

The transfer functions from the lab scale CCD DOE were used to predict a tribo decrease for the carrier of 5.0 μC/g while keeping the conductivity the same, and another carrier was produced.

The process of Example IV was repeated to obtain a carrier having 9.46 wt. % VULCAN 72R carbon black in the carrier coating. The coating was fused at 394.4° F. and the coating weight was 0.975 wt. %. A yellow developer was formed by the described method. Results for the carrier are shown in Table 12 below.

TABLE 12

| | | | |
|---|---|---|---|
| predicted tribo 70° F. 50% RH | 48.15 μC/g | actual tribo 70° F. | 45.73 μC/g |
| predicted conductivity 750 V | 9.19 [mho/cm] | actual conductivity 750 v | 8.87[mho/cm] |

These results confirmed that a good match to the desired parameters could be made using a pilot scale polymer with pilot scale mixed and fused carrier.

The next step for the carrier optimization was to ensure that the bench properties were also realized in the printer. It was desirable to test some of the latitude variability for the carrier, and since a high tribo and nominal tribo carrier had already been made, a lower tribo carrier was desired.

Example VI

The transfer functions from the pilot scale CCD DOE were used to predict another tribo decrease for the carrier of 5.0 μ/g while keeping the conductivity the same and another carrier was produced.

A lab scale carrier was prepared by the process described in Example IV. The amount of carbon black in the carrier coating was 9.30 wt %, the coating weight was 0.80 wt. %, the fusing temperature was 394.4° F., and the toner was XEROX® 700 yellow toner. Results for the carrier are shown in Table 13 below.

TABLE 13

| | | | |
|---|---|---|---|
| predicted tribo 70° F. 50% RH | 43.15 μC/g | actual tribo 70° F. | 40.63 μC/g |
| predicted conductivity 750 V | 9.19 [mho/cm] | actual conductivity 750 v | 8.24 [mho/cm] |

Example VII

Figure 5:
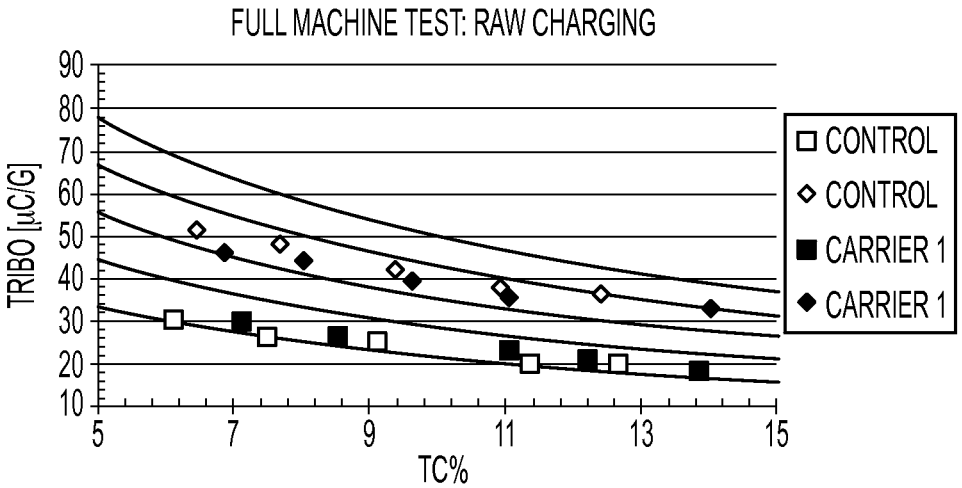
FIGS. 5 and 6 represent data generated for carrier prepared in Example V and for the solution coated carrier control for tribo and charging capability vs. toner concentration in A-zone and J-zones.
Figure 6:
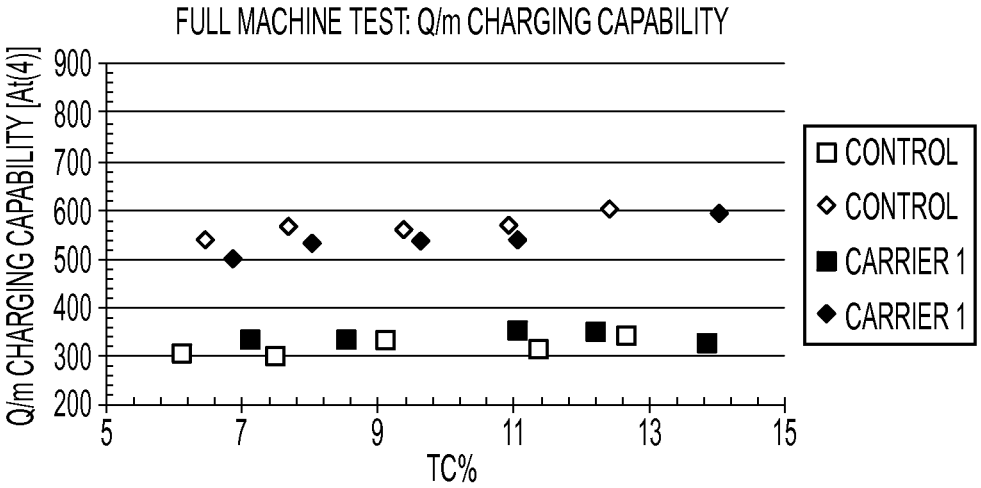
Figure 7:
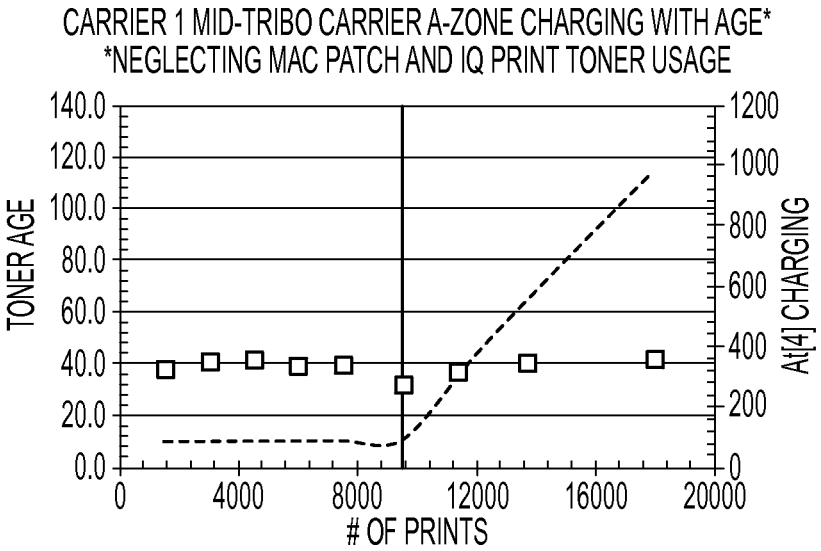
FIGS. 7 and 9 represent data generated for carrier prepared in Example V for charging capability and toner age vs. number of prints in A- and J zones.
Figure 8:
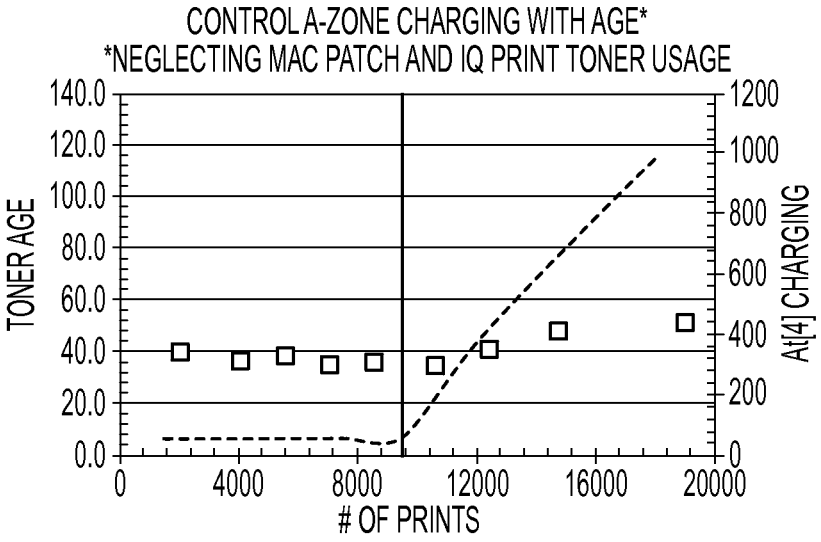
FIGS. 8 and 10 represent data generated for the solution coated carrier control for charging capability and toner age vs. number of prints in A- and J zones for comparison to FIGS. 7 and 9.
Figure 9:
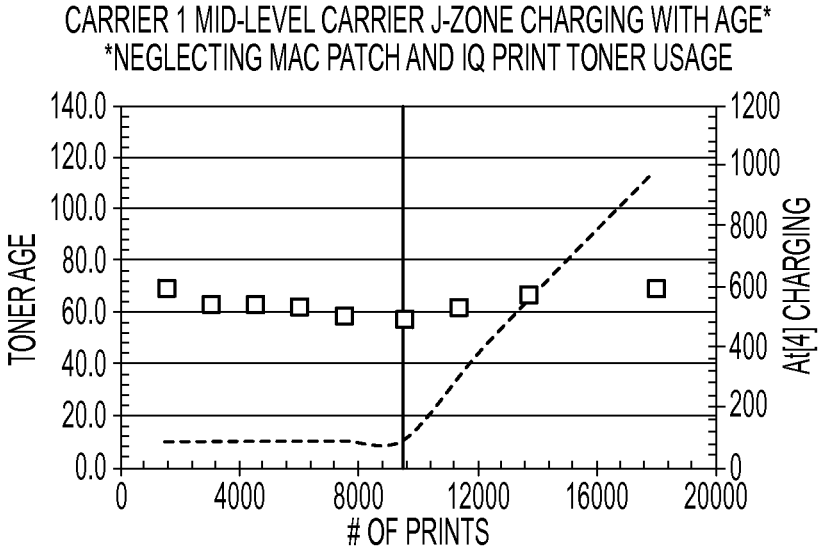
Figure 10:
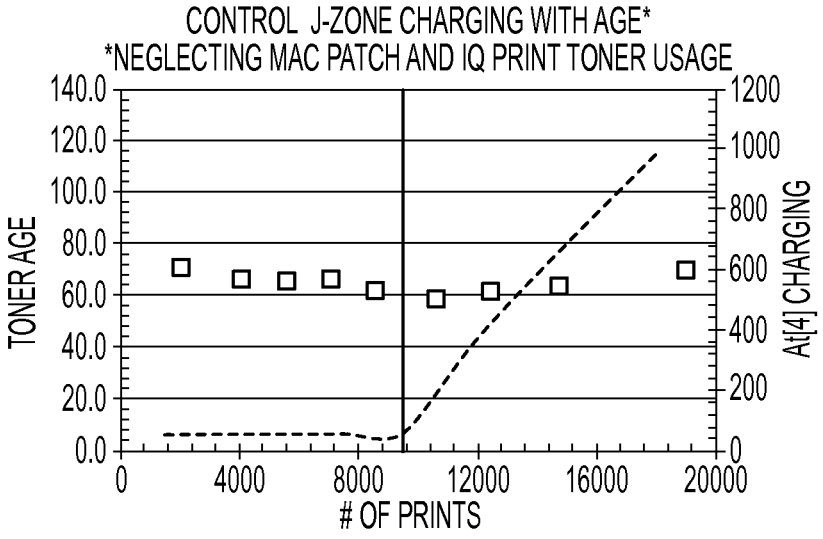
Figure 11:
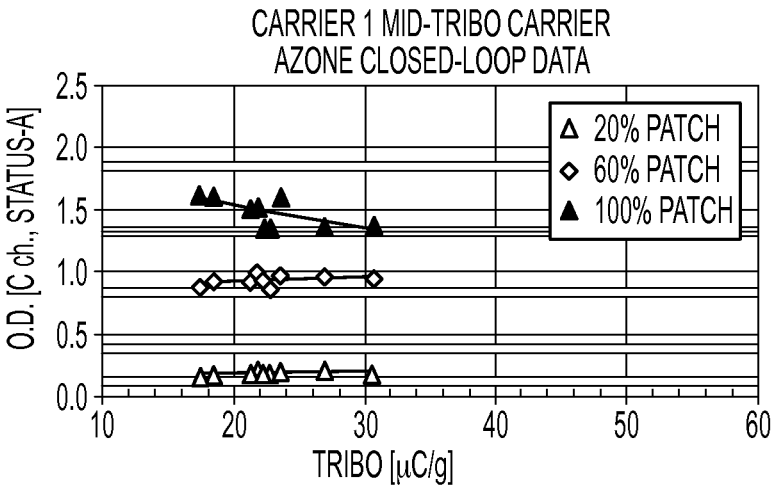
FIGS. 11 and 13 represent data generated for carrier prepared in Example V for optical density vs. tribo in A-zone and J-zone.
Figure 12:
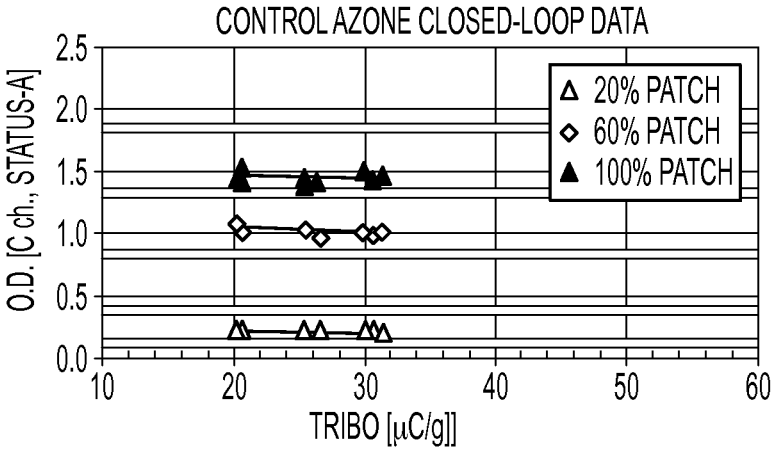
FIGS. 12 and 14 represent data generated for the solution coated carrier control for optical density vs. tribo in A-zone and J-zone for comparison to FIGS. 11 and 13.
Figure 13:
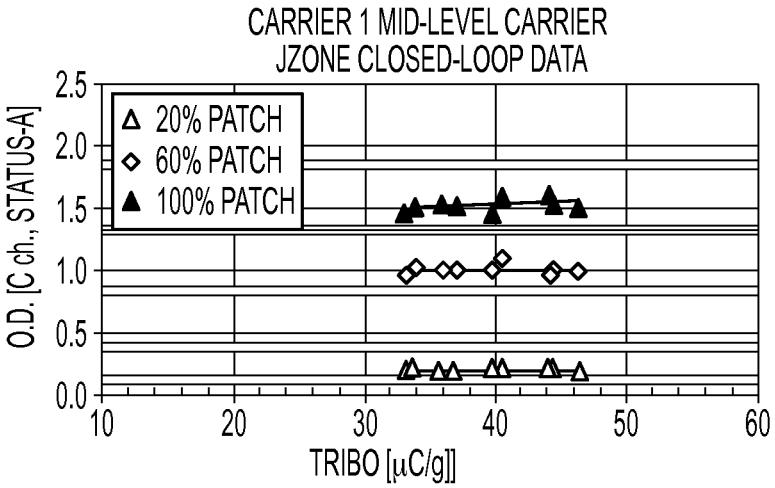
Figure 14:
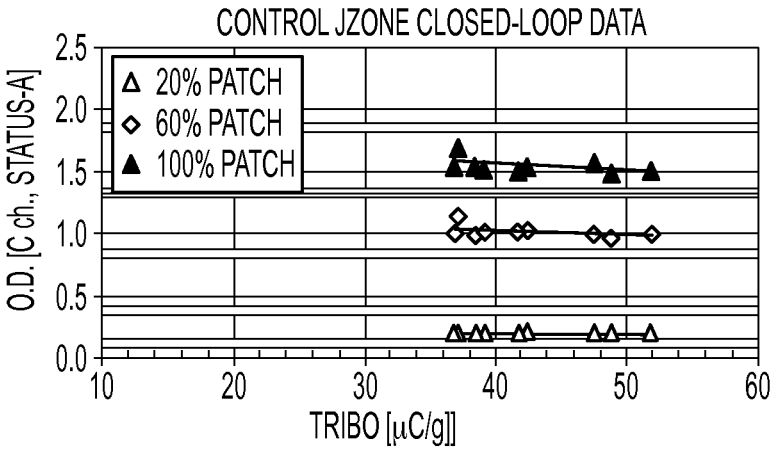
Figure 15:
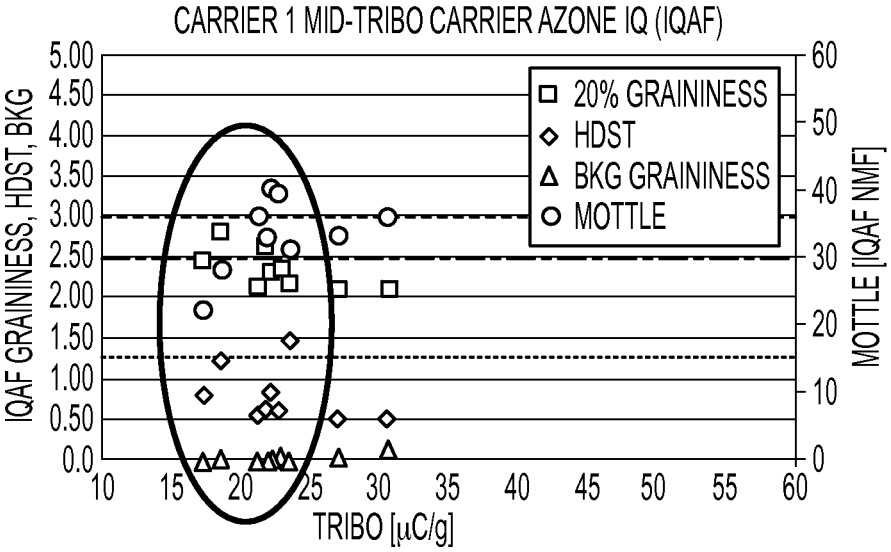
FIGS. 15 and 17 represent data generated for carrier prepared in Example V for graininess, background, mottle, and Halftone aDjacency STarvation vs. tribo in A-zone and J-zone.
Figure 16:
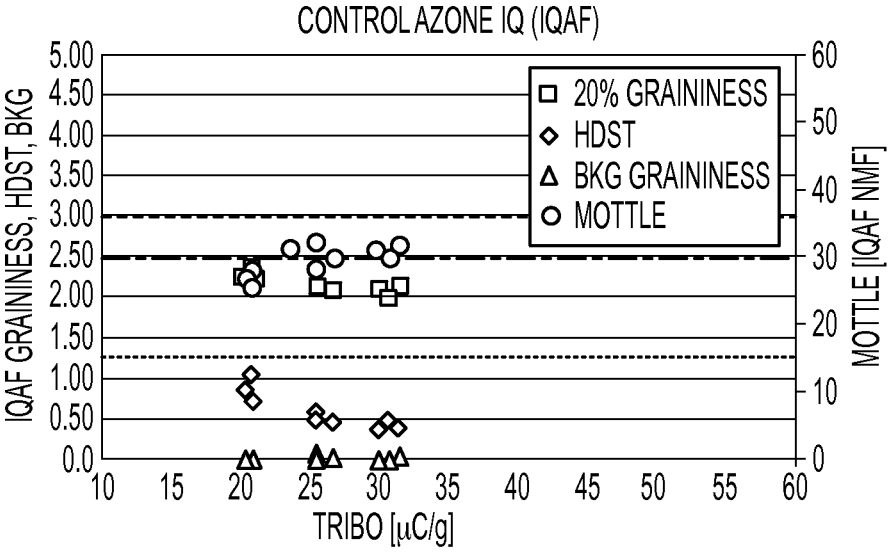
FIGS. 16 and 18 represent data generated for the solution coated carrier control for graininess, background, mottle, and Halftone aDjacency STarvation vs. tribo in A-zone and J-zone for comparison to FIGS. 15 and 17.
Figure 17:
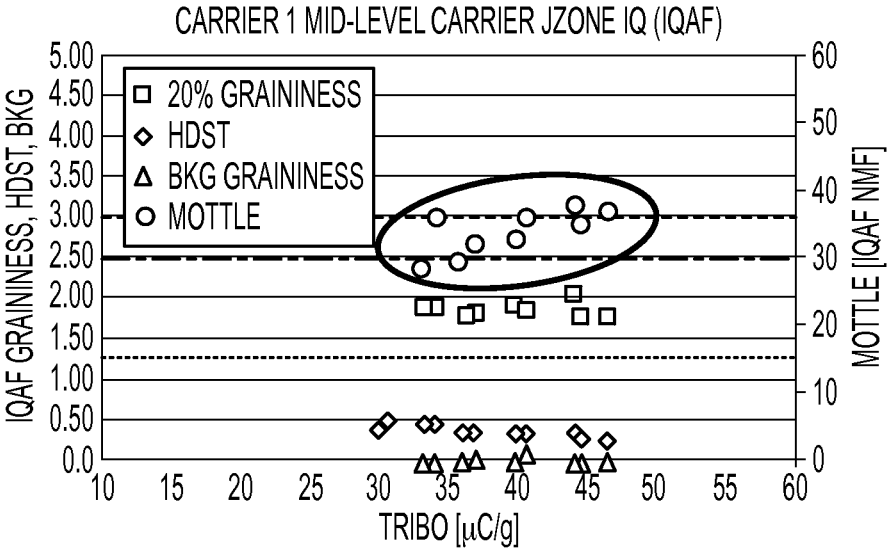
Figure 18:
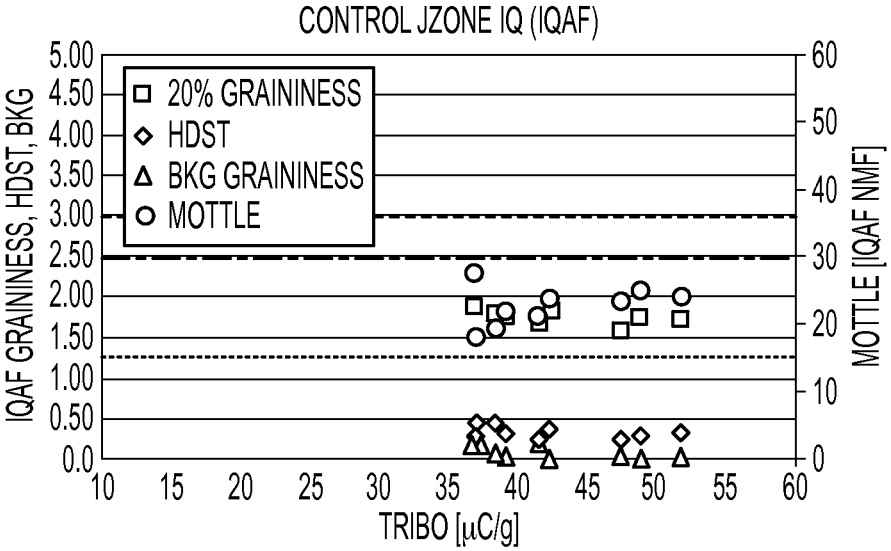

The Mid-Level Tribo Carrier 1 from Example V above was tested in a XEROX® 700 machine with a XEROX® 700 cyan toner and compared to a XEROX® 700 control carrier prepared by solution coating methods having the desired tribo charging value, as described in U.S. Patent Publication 2008/0056769, which is hereby incorporated by reference. Toner concentrations (TC) were varied from 6 wt % to 14 wt % in 80° F.@80% RH (A Zone) and in 70° F.@10% RH (J Zone). A and J zone testing was used because they are stress cases for the machine performance. Raw charging Q/m (μC/g) is compared in FIG. 5 and (Q/m) Charging Capability also known as $A_t$ which={Tribo [μC/g] multiplied by the sum of (Toner Concentration [TC] {%} added to $C_0$ [In this case=4])} or (Tribo×[TC+$C_0$]) is compared in FIG. 6.

Carrier 1 performed very close to the control carrier. Toner age and the number of prints made during the test in the machine were controlled, and a comparison of the Q/m charging capability {$A_t$(4)} to toner age and number of prints was also performed. The results are shown in FIGS. 7, 8, 9 and 10.

In FIGS. 7, 8, 9 and 10, the left-hand Y-axis and solid curve is the toner age in minutes. The right-hand Y-axis and data points are the Q/m charging capability {$A_t$(4)}. The X-axis is the number of prints. Comparisons of the Carrier 1 plots in A and J zones (FIGS. 7 and 9) to the control carrier plots in A and J zones (FIGS. 8 and 10) show the two materials to have similar aging behaviors.

During the test, prints with varying optical density patches were made on XEROX® Color Expressions Select. 20%, 60%, and 100% density patches were compared to the tribo (μC/g) of both Carrier 1 and the XEROX® 700 control carrier. These data are shown in FIGS. 11, 12, 13 and 14.

The Y-axis is the measured cyan optical density (OD). The X-axis is tribo (μC/g). In each case, the top two lines represent the expected range for OD of a 100% patch, the middle line represents the expected range for OD of a 60% patch and the bottom two lines represent the expected OD for a 20% patch. Comparisons of the plots for Carrier 1 in A and J zones (FIGS. 11 and 13) to the plots for the XEROX® 700 control carrier in A zone and J zones (FIGS. 12 and 14) show the two materials to have similar ODs for all three patches at similar tribos. The same prints made during the test were also tested for graininess, background, mottle, and Halftone aDjacency STarvation (HDST) using Image Quality Analysis Facility (IQAF), an automated image analysis system. Results are shown in FIGS. 15, 16, 17 and 18.

Figure 19:
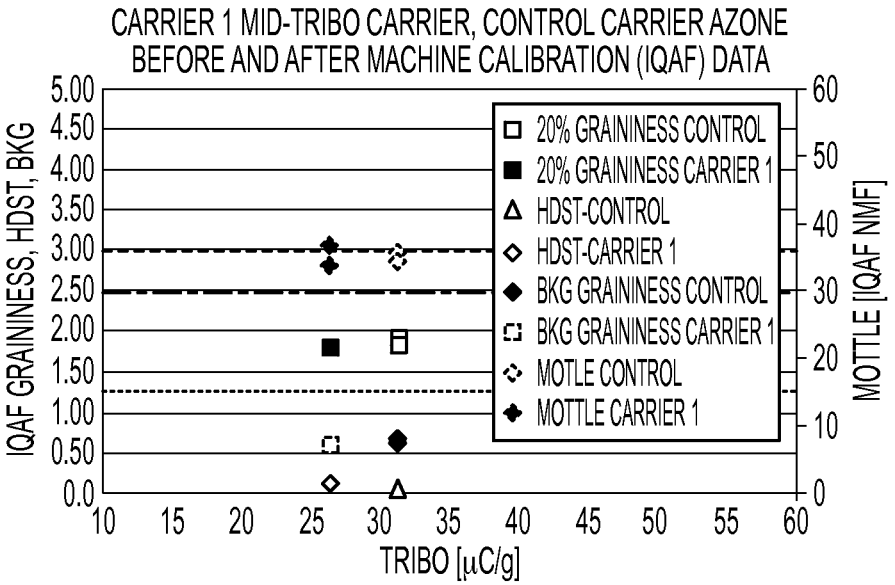
FIG. 19 represents data generated for carrier prepared in Example V and the solution coated carrier control for graininess, background, mottle, and Halftone aDjacency Starvation vs. tribo in A-zone after machine calibration was performed.
Figure 20:
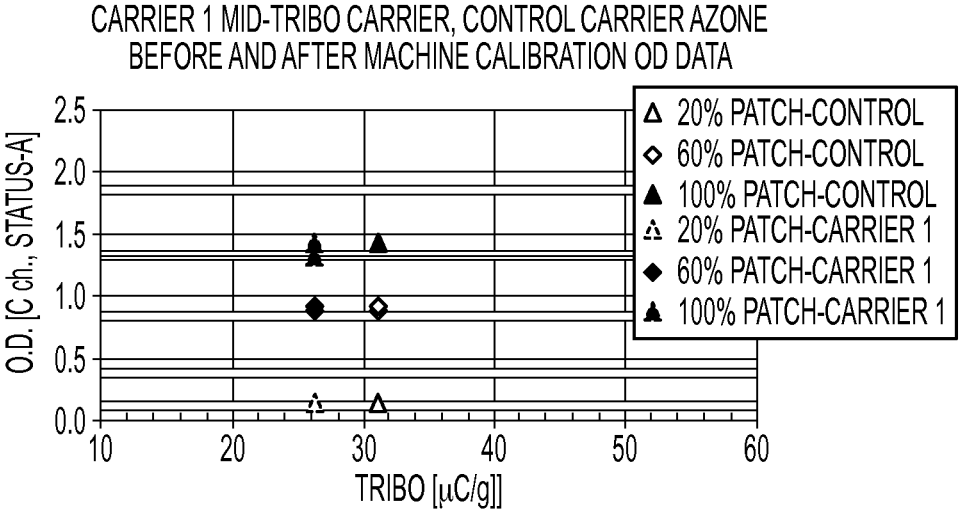
FIG. 20 represents data generated for carrier prepared in Example V and the solution coated carrier control for Optical Densities vs. tribo in A-zone after machine calibration was performed.

The left Y-axis is the IQAF rating scale for graininess, background, and HDST. The right Y-axis is the IQAF rating scale for mottle. The X-axis is tribo in μC/g. The two circled areas are what first appear to be differences for Carrier 1 when compared to the control carrier. However for the background graininess and the 20% graininess data in A zone the raster output scanner (ROS) was noted to be contaminated, which would affect these data. For the mottle data a calibration issue had occurred. After calibration, the data fell in line with the control carrier at the same optical densities as shown in FIGS. 19 and 20.

Example VIII

Figure 21:
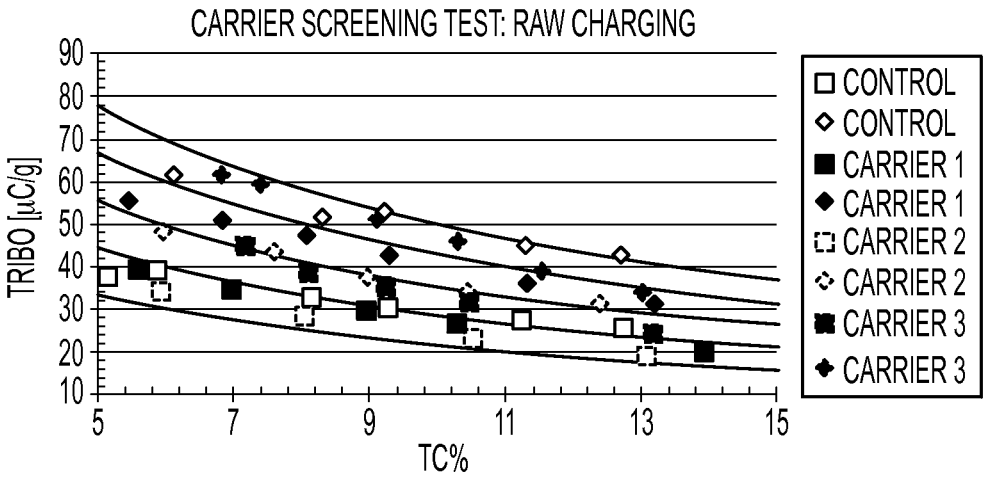
FIGS. 21 and 22 represents data generated for carriers prepared in Examples IV (labeled "Carrier 3"), V (labeled "Carrier 1"), VI (labeled "Carrier 2") and the solution coated carrier control for tribo and charging capability vs. toner concentration in A-zone and J-zones.

Machine tests were performed with the lower charging Carrier 2 from Example VI above the higher charging Carrier 3 from Example IV. This test was a short screening test to explore the latitude boundaries of the machine. These two carrier spanned the latitude range for charging and conductivity for the machine and were again stress cases for the machine's performance. Carrier 1 was also rerun in this test. Toner concentrations (TC) were varied from 5 wt % to 14 wt % in 80° F.@80% RH (A Zone) and in 70° F.@10% RH (J Zone). Raw charging Q/m (tribo μC/g) and Q/m charging capability At(4) were compared in the plots in FIGS. 21 and 22.

Figure 22:
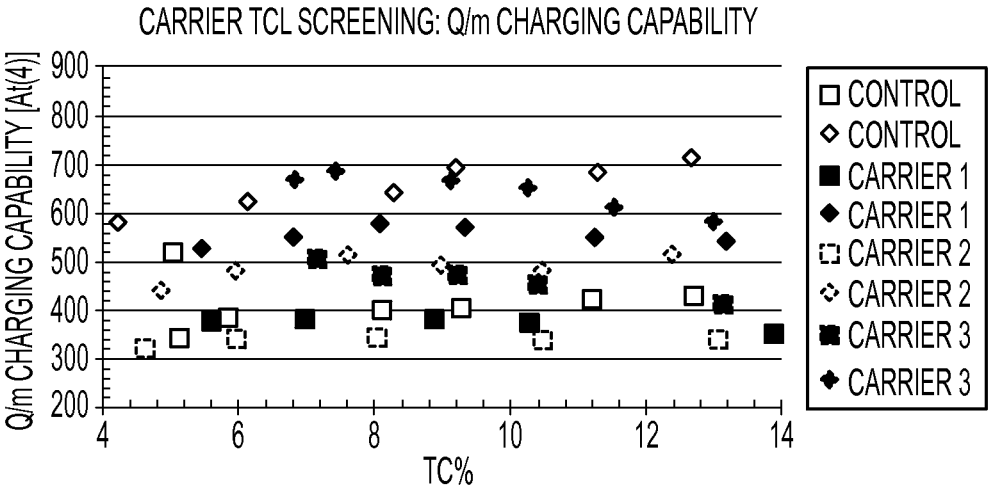
Figure 23:
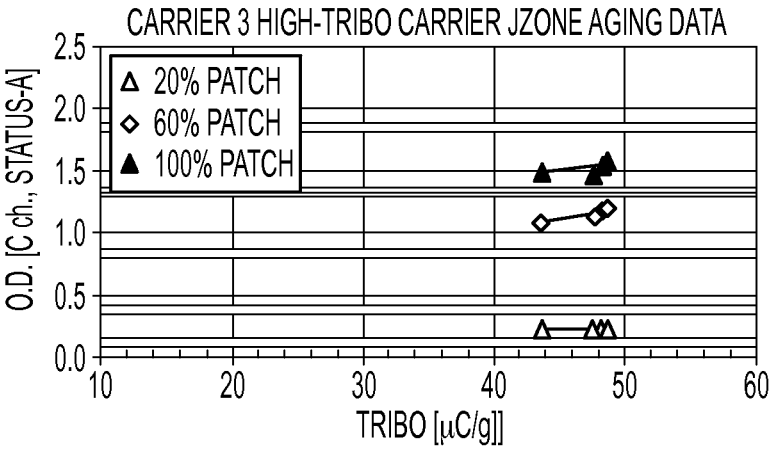
FIGS. 23, 24, and 25 represent data generated in Examples IV (Carrier 3), V (Carrier 1) and, VI (Carrier 2) for optical density vs. tribo in J-zone.
Figure 24:
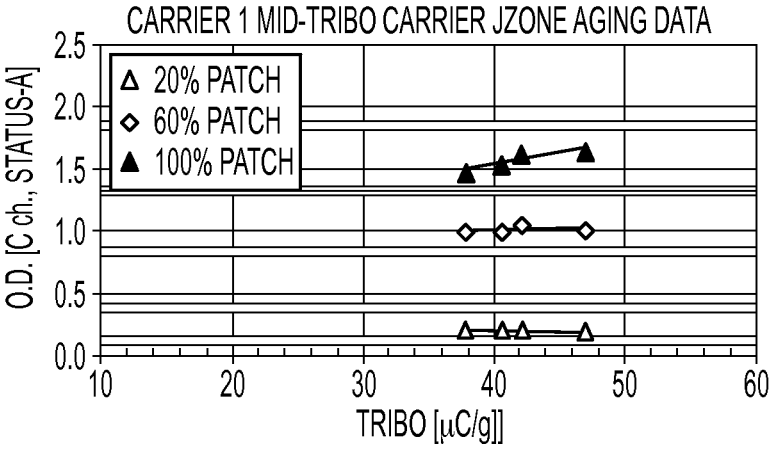
Figure 25:
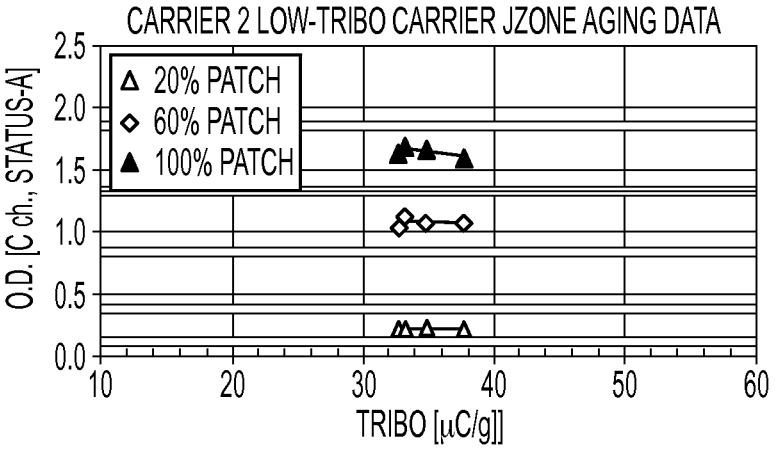

Carrier 1 performed very close to the control carrier. The three powder coated Carriers 1, 2, and 3 span the desired range for raw charging (Tribo μC/g) in FIG. 21. The dark lines represent the theoretical Q/m charging capability ($A_t$) for raw charging in the range observed. The dark rectangle in FIG. 22 represents the observe values for the XEROX® 700 control carrier used. OD measurements at the 20%, 60%, and 100% patch levels were again performed and all three carriers performed inside the expected ranges. These data are shown in FIGS. 23, 24, and 25.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefore, is not intended to limit a claimed process to any order except as specified in the claim itself.

What is claimed is:

1. A powder coated carrier for an electrophotographic developer comprising:

(a) a ferrite core; and (b) a coating comprising:

(i) a copolymer of cyclohexylmethacrylate and dimethylaminoethylmethacrylate, wherein the copolymer contains from about 0.8 to about 1.0 wt % dimethylaminoethylmethacrylate;

(ii) a melamine-formaldehyde resin; and (iii) carbon black present in an amount of from about 9.2 to about 9.7 wt % of the coating;

said coating being present in an amount of from about 0.85 to about 1.25 wt % of the carrier;

said coated carrier having a conductivity of from about 8.9 to about 9.5 [log(mho/cm)], wherein the carrier core has a surface roughness of from about 0.163 to about 0.167 $m^2/g$ as measured by the BET (Brunauer Emmett Teller) method.

2. A carrier according to claim 1 wherein the melamine-formaldehyde resin is present in an amount of from about 8 to about 12 wt % of the coating.

3. A carrier according to claim 1 wherein the carrier core has an average particle diameter when measured by laser diffraction of from about 30 to about 45 μm.

4. A carrier according to claim 1 wherein the carrier core has a conductivity of from about 7.25 to about 8.50 [Log (mho/cm)] at 500 v DC.

5. A carrier according to claim 1 wherein the carrier core comprises:

(a) a mixture of iron oxide, manganese oxide, lithium oxide;

(b) a mixture of iron oxide, manganese oxide, magnesium oxide, and strontium oxide;

(c) a mixture of iron oxide, manganese oxide, magnesium oxide, and calcium oxide; or (d) a mixture thereof.

6. A developer composition comprising:

(a) an emulsion aggregation toner comprising:

(i) an amorphous polyester resin;

(II) a crystalline polyester resin;

(iii) a wax; and (iv) a colorant; and (b) a powder coated carrier comprising (i) a ferrite core; and (ii) a coating comprising:

(A) a copolymer of cyclohexylmethacrylate and dimethylaminoethylmethacrylate, wherein the copolymer contains from about 0.8 to about 1.0 wt % dimethylaminoethylmethacrylate;

(B) a melamine-formaldehyde resin; and (C) carbon black present in an amount of from about 9.2 to about 9.7 wt % of the coating;

said coating being present in an amount of from about 0.85 to about 1.25 wt % of the carrier;

said coated carrier having a conductivity of from about 8.9 to about 9.5 [Log(mho/cm)], wherein the carrier core has a surface roughness of from about 0.163 to about 0.167 $m^2/g$ as measured by the BET (Brunauer Emmett Teller) method, and further wherein the carrier exhibits a triboelectric (Q/m) at 8% Toner Concentration of at least about 32 microCoulombs/gram (μC/g).

7. A developer according to claim 6 wherein the melamine-formaldehyde resin is present in an amount of from about 8 to about 12 wt % of the coating.

8. A developer according to claim 6 wherein the carrier core has an average particle diameter when measured by laser diffraction of from about 30 to about 45 μm.

9. A developer according to claim 6 wherein the carrier core has a conductivity of from about 7.25 to about 8.5 [Log (mho/cm)] at 500 v DC.

10. A developer according to claim 6 wherein the carrier core comprises:

(a) a mixture of iron oxide, manganese oxide, lithium oxide;

(b) a mixture of iron oxide, manganese oxide, magnesium oxide, and strontium oxide;

(c) a mixture of iron oxide, manganese oxide, magnesium oxide, and calcium oxide; or (d) a mixture thereof.

11. A developer according to claim 6 wherein the amorphous resin is of the formula

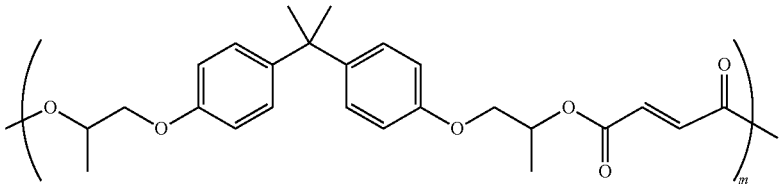

wherein m is from about 5 to about 1000.

12. A developer according to claim 6 wherein the amorphous resin is terpoly-(propoxylated bisphenol A-fumarate)-terpoly(propoxylated bisphenol A-terephthalate)-terpoly-(propoxylated bisphenol A-2-dodecylsuccinate).

13. A developer according to claim 6 wherein the crystalline resin is of the formula

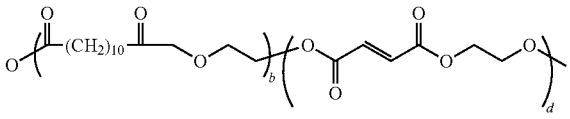

wherein b is from about 5 to about 2000 and d is from about 5 to about 2000.

14. A developer according to claim 6 wherein the crystalline resin is poly(nonane-dodecanoiate).

15. A carrier for an electrophotographic developer made by a process which comprises:

(a) preparing a latex copolymer of cyclohexylmethacrylate and dimethylaminoethylmethacrylate, wherein the copolymer contains from about 0.8 to about 1.2 wt % dimethylaminoethylmethacrylate;

(b) preparing dry particles of the copolymer having a particle size of from about 80 to about 120 nm;

(c) preparing a carrier coating by mixing the dry copolymer particles with:

(i) carbon black, present in an amount of from about 9.2 to about 9.7 wt % of the carrier coating; and (ii) a melamine-formaldehyde resin;

(d) mixing the carrier coating with ferrite cores;

(e) heating the mixture of carrier coating and ferrite cores at a temperature of from about 385 to about 405° F. for a period of from about 20 to about 30 minutes, thereby fusing the carrier coating to the ferrite core; and (f) screening the coated carrier particles;

said coated carrier particles having:

(1) a coating weight of from about 0.85 to about 1.25 wt %; and (2) a conductivity of from about 8.9 to about 9.5 [Log (mho/cm)]; and wherein the cores have a surface roughness of from about 0.163 to about 0.167 $m^2/q$ as measured by the BET (Brunauer Emmett Teller) method.

16. A carrier according to claim 15 wherein fusing is done in a rotary kiln.

17. A carrier according to claim 15 wherein fusing is performed for a period of from about 20 to about 30 minutes.

18. A carrier according to claim 15 wherein the melamine-formaldehyde resin is present in an amount of from about 8 to about 12 wt % of the coating.

* * * * *